US005575320A

United States Patent [19]

Brisson

[11] Patent Number: 5,575,320

[45] Date of Patent: Nov. 19, 1996

[54] CUTTING TOOL ASSEMBLY FOR A ROTATABLE CHIP FORMING HEAD

[75] Inventor: Maurice Brisson, Laval, Canada

[73] Assignee: Les Ateliers Benoit Allard, Inc., Quebec, Canada

[21] Appl. No.: 371,164

[22] Filed: Jan. 11, 1995

[51] Int. Cl.[6] ..... B27G 13/04

[52] U.S. Cl. ..... 144/220; 144/176; 144/218; 407/37; 407/47; 407/73; 407/77; 407/79

[58] Field of Search ..... 144/162 R, 176, 144/218, 241, 220, 225, 228, 231; 407/37, 47, 49, 40, 101, 46, 48, 113, 73, 75, 77, 79, 87, 108

[56] References Cited

U.S. PATENT DOCUMENTS

| | | | |
|---|---|---|---|
| 734,374 | 11/1903 | Bresman | 144/228 |
| 815,161 | 3/1906 | Hall | 144/228 |
| 883,148 | 3/1908 | Sanders | 144/228 |
| 4,082,127 | 4/1978 | Miller | 144/220 |
| 4,444,233 | 4/1984 | Miller | 144/220 |
| 5,271,442 | 12/1993 | Carpenter et al. | 144/218 |

*Primary Examiner*—W. Donald Bray
*Attorney, Agent, or Firm*—Omri M. Behr, Esq.

[57] ABSTRACT

The disclosure describes a cutting tool assembly for mounting unto a rotatable chip forming head. It comprises a knife holder having a base portion which is adapted to be secured peripherally to the head and a cantilevered plate portion having a lower section integral with the base portion and an upper section extending obliquely over the base portion. The cantilevered arrangement of the knife supporting plate enables the lateral ejection of chips produced from a solid piece of wood during operation so that chips do not contact successive cutting tool assemblies as the head rotates.

7 Claims, 3 Drawing Sheets

CUTTING TOOL ASSEMBLY FOR A ROTATABLE CHIP FORMING HEAD

FIELD OF THE INVENTION

The present invention pertains to a cutting tool assembly which is adapted to be mounted unto the rotatable core of a chip forming machine, such as a chipping canter head.

BACKGROUND OF THE INVENTION

Present technology consists in mounting normally up to eight knife holders onto the peripheral flat faces of a solid polygonal core, which is itself keyed to a motorized rotating shaft.

The shape of the knife holder presently utilized is generally that of a four-sided open-ended box of which the bottom side is affixed to a face of the polygonal core and the top side serves as a mounting surface for the cutter knife.

Such arrangement causes the chips produced by the knife to pass through the box and, upon ejecting at the rear end, to meet the forward edge of the outside wall of the next incoming knife holder. At this point, part of the chips produced by the preceding knife will deflect outside of the circular orbit of the knives and holders, while some chips will engage into the tunnel arrangement of the next holder and even repeat the process to the point of being carried back to the cutting area where they were produced. Therefore, any recutting of existing chips or impact with holder walls, are greatly detrimental to chip quality because of splintering of the wood fibres.

Given the present design of knife holders, attempts have been made to minimize chip quality downgrading by increasing the distance between the knife holders so as to facilitate the chip escape outside the path of incoming knife holders. This has resulted in providing larger diametrical head dimensions. However, by thus increasing the cutting circle, the knife cutting velocity becomes higher which, in turn, causes more severe knife impact on the wood and additional fibre splintering, specially under frost conditions.

It is known in the chip making technology that the cutter head RPM is related only to feed rate, the number of cutter knives and the required chip length. Assuming constant values for these three factors, any change in the cutting circle diameter directly affects the knife velocity and impact on the wood since no change in RPM occurs.

OBJECTS AND STATEMENT OF THE INVENTION

It is an object of the invention to overcome the above described problems.

This has been achieved with the present invention by the elimination of the outer lateral wall found on present knife holders and by the provision of a newly shaped knife holder which permits mechanical and performance improvements for polygonal cutter head assemblies used in chipper canters for cutting flat faces on round wood stock (logs). Such cutter heads are used singly or in pairs, to the extent of producing squared pieces from the logs and wood chips from the volume external to the finally cut profile.

The present invention therefore relates to a cutting tool assembly for mounting to a rotatable chip forming head which comprises:

a knife holder including a base portion adapted to be secured peripherally to the head and a cantilevered plate portion having a lower section joined to the base portion and an upper section extending obliquely over the base portion at a distance thereof; the upper section having an inner face and a front working side;

a knife mounted to bear against the inner face of the holder; the knife having a cutting edge extending frontwardly beyond the working side of the upper section; and means securing the knife to the cantilevered plate.

The present invention thus provides the elimination of any chip impact or friction against the outer wall of conventional holders, thus providing the unimpeded sideways ejection of chips, preventing a carry-over process from one knife holder to the next which could bring back some chips to the cutting area of the canter.

The cutting tool of the present invention further allows, as a result of instant chip ejection, to place knife holders in end-to-end contact therefore reducing the cutting circle and knife velocity; this is an important advantage over conventional assemblies where knife holders have to be spaced because of their tunnel shape.

Also, in addition to chip quality upgrade, further benefits consist in a smaller mechanical assembly of the cutter head and of its supporting structure, therefore resulting in a reduction of production costs of the unit, working space and power requirements.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
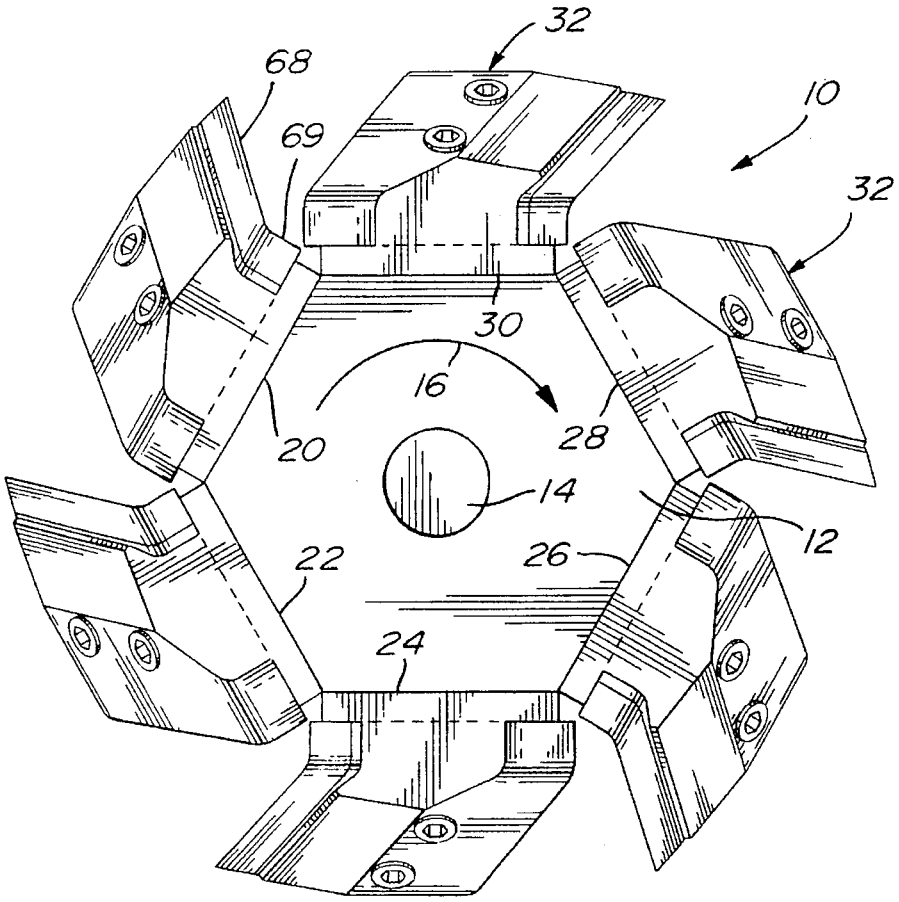
FIG. 1 is a front elevation view of a rotatable chipping head using a series of cutting tool assemblies made in accordance with the present invention.

Referring to FIG. 1, there is shown a chip forming machine, such as a chipping canter head, generally designated 10, that comprises a polygonal shaped core 12 adapted to rotate with a shaft 14 in the direction indicated by arrow 16.

The polygonal body 12 shown is hexagonal with six contiguous peripheral faces 20, 22, 24, 26, 28 and 30, to each of which is mounted a cutting tool assembly, generally denoted 32, made in accordance with the present invention.

Figure 2:
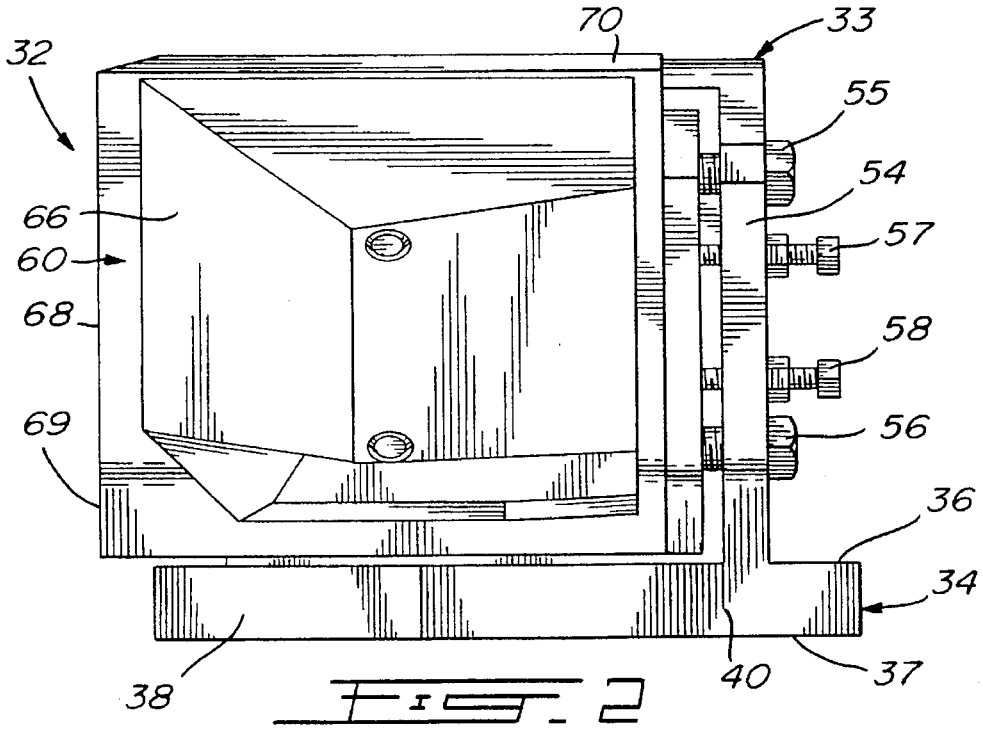
FIG. 2 is a side elevation of the cutting tool assembly.
Figure 3:
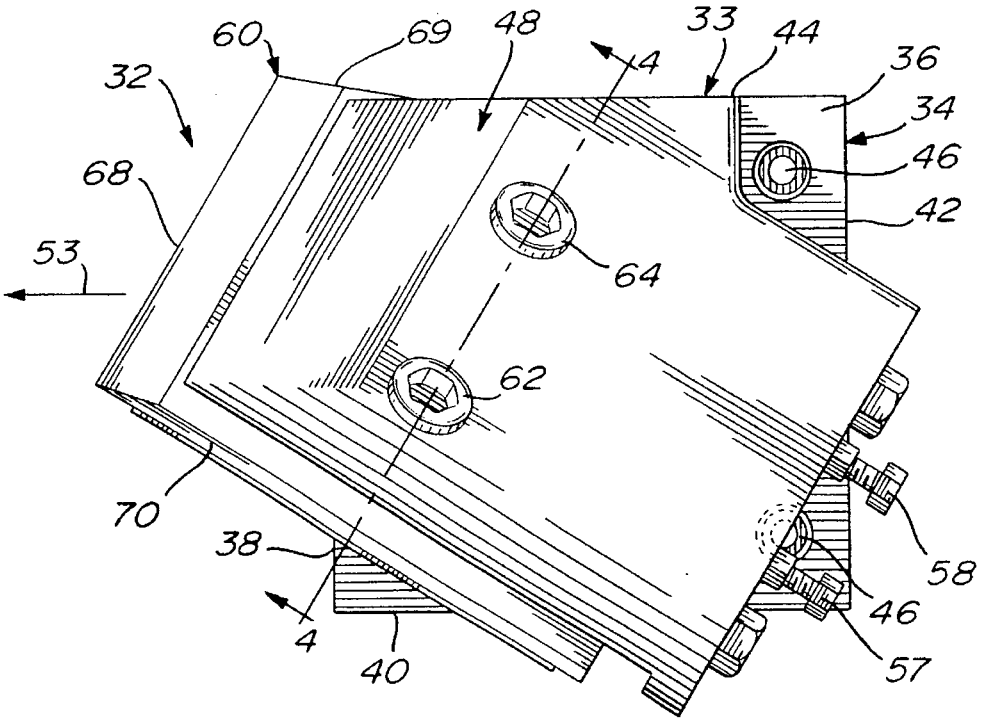
FIG. 3 is a top plan view thereof.

Referring to FIGS. 2 and 3, the cutting tool assembly 32 comprises a knife holder 33 that includes rectangular base portion 34 having a top face 36, a bottom face 37, and sides 38, 40, 42 and 44. The base portion 34 has a series of holes 46 allowing a corresponding number of fastening elements to secure it to a peripheral face of the polygonal core 12.

Figure 4:
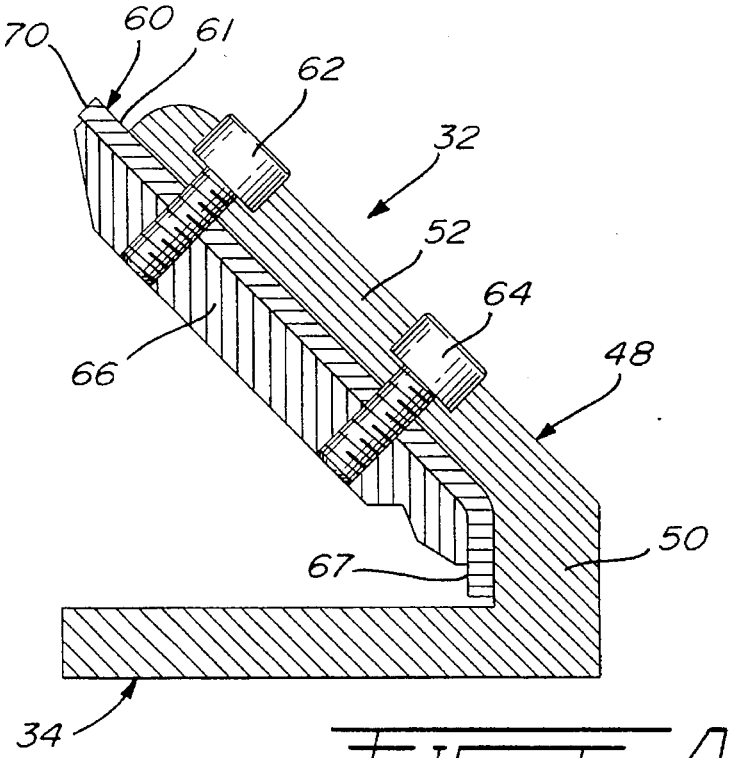
FIG. 4 is a cross sectional view taken along lines 4—4 of FIG. 3.

Referring to FIG. 4, the knife holder assembly 33 also comprises a cantilevered plate portion, generally denoted 48, that includes a lower section 50 joined to the base portion 34 and an upper inclined section 52 which is inclined upwardly relative to the base portion. It is understood that the joining of the plate portion to the base portion may be accomplished by the making of a single integral element or by solidly securing the two portions together. The lower section 50 of the cantilevered plate portion extends obliquely in plan view relative to the rectangular base 34 of the tool holder and to the rotational direction of the assembly indicated by arrow 53. As illustrated in FIG. 2, the cantilevered plate portion 52 includes a rear flange 54 to which is mounted a series of screws 55, 56, 57 and 58, the function of which will be described hereinbelow.

To the inner face of the cantilevered plate portion 48, is mounted a knife 60 having a top face 61 bearing and secured to the plate by means of a pair of securing screws 62 and 64, the lower ends of which engage a clamp 66 forcing the latter to bear against the lower face 67 of the knife.

Figure 7:
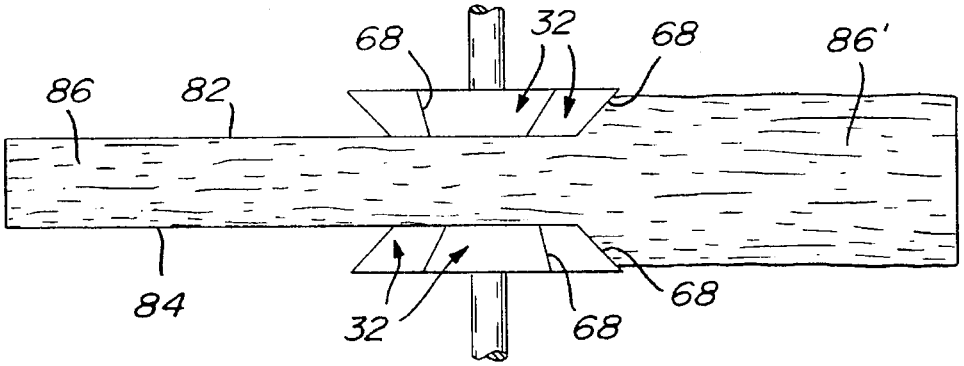
FIG. 7 is a schematic view showing two chipping heads canting a log.

As illustrated in FIGS. 2 and 3, the knife 60 comprises a continuous cutting edge that includes a main section 68 and a shorter section 69, extending beyond the front working sides of the cantilevered plate portion 52. Cutting edge section 68 is the main chipping edge (as shown in FIG. 7); it extends upwardly and obliquely relative to the base portion 34 of the knife holder and, more particularly, to the front wall 38 of the base. The cutting edge section 69 extends perpendicular to the top wall 36 of the base 34.

Figure 5:
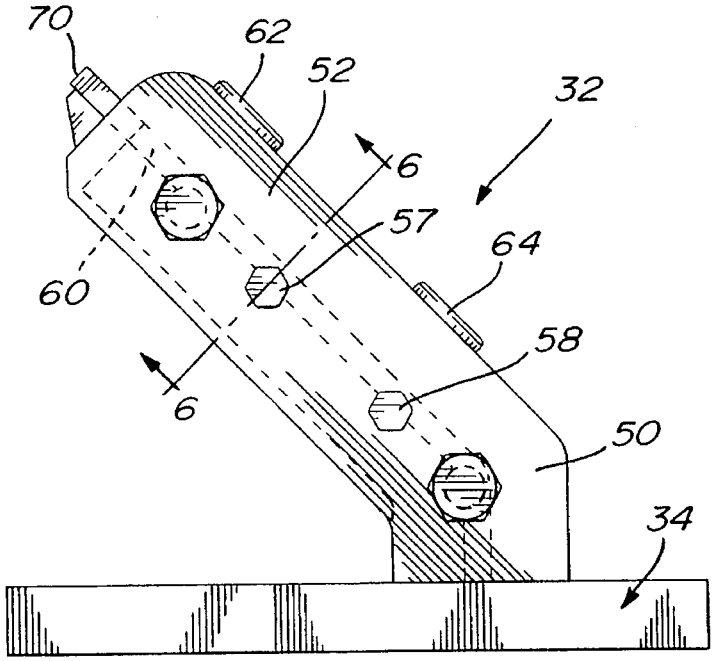
FIG. 5 is a rear view as seen from the right of FIG. 2.
Figure 6:
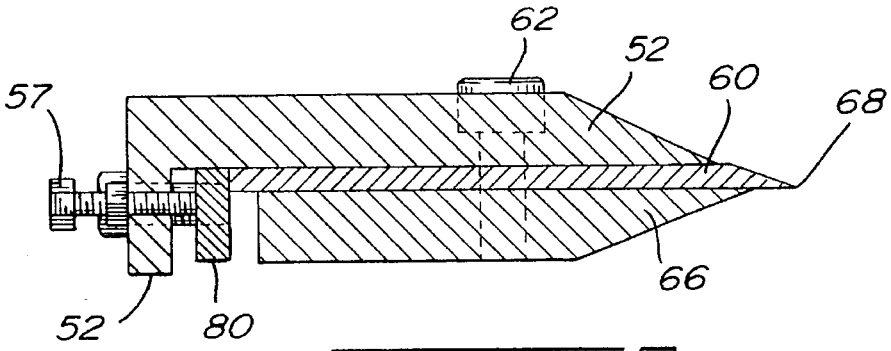
FIG. 6 is a cross sectional view taken along lines 6—6 of FIG. 5.

Referring to FIGS. 5 and 6, the positioning of the knife within the holder is accomplished by adjusting screws 57 and 58 which bear against plate 80 to push the knife frontwardly as they are tightened and by also adjusting screws 55 and 56 which, by having a portion thereof threadedly engaged in plate 80, pull the plate backwardly as they are tightened.

FIG. 7 shows that, in the case of a chipper canter, two chip forming heads are used to form the opposite planar faces 82 and 84 of a cant 86. Once portion 68 of the cutting edge has chipped away into the log 86', portion 69 of the cutting edge (see FIG. 2) provides a finished surface to the cant faces 82 and 84.

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A cutting tool assembly for mounting to a rotatable chip forming head comprising:

a knife holder including a base portion having opposite sides and being adapted to be secured peripherally to said head and a cantilevered plate portion having a lower section joined to one of said opposite sides of said base portion and an upper section extending obliquely above said base portion; said upper section defining an inner face and a front working side, said front working side extending above the other of said of opposite sides of said base portion to define therebetween an open side for chip ejection;

a knife mounted to bear against said inner face of said holder; said knife having a cutting edge extending frontwardly beyond said working side of said upper section; and means securing said knife to said cantilevered portion.

2. A cutting tool assembly as defined in claim 1, wherein said securing means consist of a clamp bearing against said knife and having edges disposed inwardly of said cutting edge, and of fastening elements for releasably securing said clamp against said knife.

3. A cutting tool assembly as defined in claim 2, wherein the cutting edge of said knife includes a main portion extending obliquely relative to the rotational direction of said head.

4. A cutting tool assembly as defined in claim 3, wherein said cutting edge further includes a lower portion extending substantially perpendicular to said base portion of said holder; said lower portion having a cutting length smaller than that of said main portion.

5. A cutting tool assembly as defined in claim 2, wherein said securing means include means mounted to the rear of said holder for adjusting the relative position of said knife in said holder.

6. A chipping canter head having a polygonal shaped core having a series of flat contiguous peripheral faces and a series of cutting tool assemblies, each tool assembly being made in accordance with claim 1; each said base portion of each said knife holder being affixed to a corresponding flat peripheral face of said core.

7. A chipping canter head as defined in claim 6, wherein each said base portion has front and rear edges; said base portions being peripherally disposed in an end-to-end contact on said core.

* * * * *